US010373755B2

(12) United States Patent
Prager et al.

(10) Patent No.: US 10,373,755 B2
(45) Date of Patent: Aug. 6, 2019

(54) HIGH VOLTAGE TRANSFORMER

(71) Applicant: EAGLE HARBOR TECHNOLOGIES, INC., Seattle, WA (US)

(72) Inventors: James R. Prager, Seattle, WA (US); Timothy M. Ziemba, Bainbridge Island, WA (US); Kenneth E. Miller, Seattle, WA (US); John G. Carscadden, Seattle, WA (US); Ilia Slobodov, Seattle, WA (US)

(73) Assignee: EAGLE HARBOR TECHNOLOGIES, INC., Seattle, WA (US)

( * ) Notice: Subject to any disclaimer, the term of this patent is extended or adjusted under 35 U.S.C. 154(b) by 174 days.

(21) Appl. No.: 15/365,094

(22) Filed: Nov. 30, 2016

(65) Prior Publication Data

US 2017/0154726 A1 Jun. 1, 2017

Related U.S. Application Data

(60) Provisional application No. 62/260,821, filed on Nov. 30, 2015.

(51) Int. Cl.
*H01F 27/28* (2006.01)
*H01F 30/16* (2006.01)
*H01F 27/24* (2006.01)

(52) U.S. Cl.
CPC ..... *H01F 30/16* (2013.01); *H01F 27/24* (2013.01); *H01F 27/2866* (2013.01);
(Continued)

(58) Field of Classification Search
CPC ..... H01F 27/2895
(Continued)

(56) References Cited

U.S. PATENT DOCUMENTS 3,086,184 A * 4/1963 Nichols ..... H01F 27/322 336/192
3,153,758 A * 10/1964 Kusters ..... G01R 1/28 324/726

(Continued)

FOREIGN PATENT DOCUMENTS

EP 0947048 A1 10/1999
WO 9828845 A1 7/1998

OTHER PUBLICATIONS

International Search Report and Written Opinion dated Feb. 17, 2017 in related PCT Application No. PCT/US2016/64164 (14 pages).

(Continued)

*Primary Examiner* — Ronald Hinson

(57) ABSTRACT

A high-voltage transformer is disclosed. The high-voltage transformer includes a transformer core; at least one primary winding wound once or less than once around the transformer core; a secondary winding wound around the transformer core a plurality of times; an input electrically coupled with the primary windings; and an output electrically coupled with the secondary windings that provides a voltage greater than 1,1200 volts. In some embodiments, the high-voltage transformer has a stray inductance of less than 30 nH as measured on the primary side and the transformer has a stray capacitance of less than 100 pF as measured on the secondary side.

15 Claims, 9 Drawing Sheets

(52) U.S. Cl.
CPC ..... *H01F 27/2895* (2013.01); *H01F 27/2804* (2013.01); *H01F 2027/2814* (2013.01)

(58) Field of Classification Search
USPC ..... 336/229
See application file for complete search history.

(56) References Cited

U.S. PATENT DOCUMENTS 4,424,469 A 1/1984 Shahbender et al.
4,631,511 A 12/1986 Sylvester, Jr. et al.
4,777,465 A * 10/1988 Meinel ..... H01F 17/0033 257/E25.031
6,348,849 B1 2/2002 Kruse et al.
6,812,916 B2 * 11/2004 Hwang ..... H05B 41/3927 315/276
6,831,377 B2 * 12/2004 Yampolsky ..... H01F 19/08 307/106
7,746,211 B2 * 6/2010 Pokharna ..... H01F 27/306 336/229
2002/0140464 A1 * 10/2002 Yampolsky ..... H01F 19/08 327/100
2003/0076202 A1 4/2003 Haugs et al.
2003/0117251 A1 6/2003 Haugs et al.
2003/0128554 A1 7/2003 Crewson et al.
2008/0157914 A1 7/2008 Pokharna et al.
2008/0186124 A1 8/2008 Schaffer et al.
2008/0204180 A1 8/2008 Aboumrad et al.
2010/0176817 A1 * 7/2010 McLean ..... G01R 31/001 324/603
2011/0291789 A1 * 12/2011 Dalmia ..... H01F 17/0006 336/200
2012/0075047 A1 * 3/2012 Luckey ..... H01F 27/08 336/60
2014/0224998 A1 8/2014 Kholomeev
2014/0268968 A1 9/2014 Richardson
2015/0130525 A1 5/2015 Miller et al.
2015/0318846 A1 11/2015 Prager et al.

OTHER PUBLICATIONS

Supplementary European Search Report dated Nov. 14, 2018 in related European Application No. EP 16871402 (2 pages).
European Extended Search Report dated Nov. 21, 2018 in related European Application No. EP 16871402 (9 pages).
European Notice of Publication in related European Application No. WO 98/28845 (1 pages).

* cited by examiner

HIGH VOLTAGE TRANSFORMER

GOVERNMENT RIGHTS

This invention was made with government support under Award Number DE-SC0011907 by the Department of Energy. The government has certain rights in the invention.

BACKGROUND

There are a number applications where high-voltage pulses may be useful. These applications range from fusion science to medical devices to space applications to semiconductor manufacturing, to name a few.

SUMMARY

A high-voltage transformer is disclosed. The high-voltage transformer includes a transformer core; at least one primary winding wound once or less than once around the transformer core; a secondary winding wound around the transformer core a plurality of times; an input electrically coupled with the primary windings; and an output electrically coupled with the secondary windings that provides a voltage greater than 1,200 volts. In some embodiments, the high-voltage transformer has a stray inductance of less than 30 nH as measured from the primary side and the transformer has a stray capacitance of less than 100 pF as measured from secondary side.

In some embodiments, the at least one primary winding comprises a plurality of conductors wound less than one time around the transformer core. In some embodiments, the at least one secondary winding comprises a single conductor wound around the transformer core a plurality of times.

In some embodiments, the transformer has at least one dimension selected from the group consisting of a radius, a width, a height, an inner radius, and an outer radius that is greater than 1 cm. In some embodiments, the transformer core has a toroid shape. In some embodiments, the transformer core has a cylinder shape.

In some embodiments, the secondary winding comprises at least a first group of windings wound around the transformer core at a first location and a second group of windings wound around the transformer core at a second location that is separate from the second location. In some embodiments, each of at least a subset of the secondary windings are spaced further apart from the transformer core than one of a neighboring winding of the subset of the secondary windings.

These illustrative embodiments are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

These and other features, aspects, and advantages of the present disclosure are better understood when the following Detailed Description is read with reference to the accompanying drawings.

DETAILED DESCRIPTION

Some embodiments of the invention include a high-voltage transformer that includes a transformer core; at least one primary winding wound once or less than once around the transformer core; and a secondary winding wound around the transformer core a plurality of times. In some embodiments, the high-voltage transformer may have a low impedance and/or a low capacitance.

In some embodiments, the high-voltage transformer may be used to output a voltage greater than 1,000 volts with a fast rise time of less than 150 nanoseconds or less than 50 nanoseconds, or less than 5 ns.

In some embodiments, the high-voltage transformer has a stray inductance of less than 100 nH, 50 nH, 30 nH, 20 nH, 10 nH, 2 nH, 100 pH as measured on the primary side and/or the transformer has a stray capacitance of less than 100 pF, 30 pF, 10 pF, 1 pF as measured on the secondary side.

Figure 1:
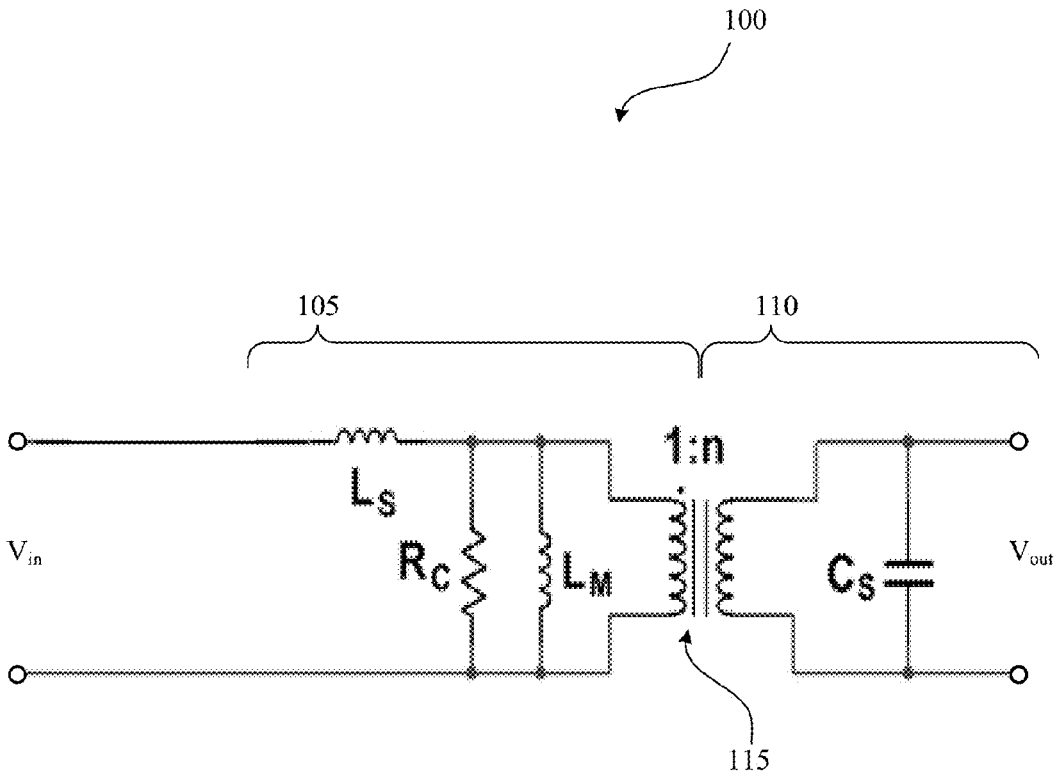
FIG. 1 illustrates circuit diagram of a transformer according to some embodiments.

FIG. 1 illustrates a circuit diagram of a transformer 100 according to some embodiments. The transformer 100 includes a single-turn primary winding and a multi-turn secondary windings around a transformer core 115. The single-turn primary winding, for example, may include one or more wires wound one or fewer times around a transformer core 115. The single-turn primary winding, for example, may include more than 10, 20, 50, 100, 250, 1200, etc. individual single-turn primary windings.

The multi-turn secondary winding, for example, may include a single wire wound a plurality of times around the transformer core 115. The multi-turn secondary winding, for example, may be wound around the transformer core more than 2, 10, 25, 50, 100, 250, 500, etc. times. In some embodiments, a plurality of multi-turn secondary windings may be wound around the transformer core.

The circuit diagram of the transformer 100 includes various possible inductance, capacitance, and/or resistance values that may be inherent in the transformer 100.

In some embodiments, the transformer may produce a voltage $V_{out}$ at the output of the transformer that has a fast rise time such as, for example, a rise time less than 100, 10, 1, etc. nanoseconds.

The stray inductance $L_s$ of the transformer 100 may include the inductance on the primary side 105 and/or the secondary side 110 of the transformer. The stray inductance $L_s$ may include inductance from a number of components and/or sources of the transformer 100. Thus, the stray inductance $L_s$, for example, may represent the equivalent or effective stray inductance of the transformer 100. The stray inductance $L_s$, for example, may be the equivalent or effective inductance of the transformer 100.

While the representation of the stray inductance $L_s$ is shown on the primary side of the transformer 100, the stray inductance $L_s$ may also be represented either on the primary side 105 or the secondary side 110, where the value of the stray inductance on the primary side 105 differs from the value of the stray inductance $L_s$ on the secondary side 110 by approximately the square of the transformer primary to secondary turns ratio, and/or the square of transformer's voltage step up ratio.

The stray inductance $L_s$ as measured or seen on the primary side may, for example, be measured by connecting an inductance meter across the transformer input $V_{in}$, with the transformer 100 disconnected from other components, and with the transformer output $V_{out}$ shorted. The stray inductance $L_s$ as measured or seen on the secondary side may, for example, be measured by connecting an inductance meter across the output $V_{out}$, with the transformer 100 disconnected from other components, and with the transformer input $V_{in}$ shorted.

The stray inductance $L_s$, for example, may be less than 1 nH ($L_s$<1 nH). As another example, the stray inductance $L_s$, may be less than 10 nH ($L_s$<10 nH), 100 nH ($L_s$<100 nH), etc. The stray inductance $L_s$ may be the inductance of the transformer 100 as measured on the primary side 105 of the transformer 100 and/or at the transformer input $V_{in}$ (or as measured from the primary side 105 of the transformer 100 and/or at the transformer input $V_{in}$).

The resistance of the core $R_s$ represents the resistance of the transformer core 115. The resistance of the core $R_s$ may include the energy lost to heating in the transformer core 115, etc.

The primary magnetizing inductance $L_M$ represents the primary magnetizing inductance of the transformer 100. The primary magnetizing inductance $L_M$, for example, may be less than 1 mH ($L_M$<1 mH). As another example, the magnetizing inductance, may be less than 100 μH ($L_M$<100 μH), 1 μH ($L_M$<1 μH), etc.

The stray capacitance $C_s$ may include the capacitive coupling between the primary winding and the secondary winding, and/or the capacitive coupling between the secondary winding and ground, and/or capacitive coupling between the secondary winding and the core or some portion thereof, and/or the capacitive coupling between one portion of the secondary winding and another portion of the secondary winding, and/or the capacitive coupling between some portion of the secondary winding and some portion of the primary winding, and/or between some portion of the secondary winding and some portion of other components and elements that are used in conjunction with the transformer, for example, a printed circuit board on which the transformer might be mounted.

The stray capacitance $C_s$ may include capacitance from a number of components and/or sources of the transformer 100. Thus, the stray capacitance $C_s$, for example, may represent the equivalent or effective stray capacitance of the transformer 100. The stray capacitance $C_s$, for example, may be the equivalent or effective capacitance of the transformer 100.

While the representation of the stray capacitance $C_s$ is shown on the secondary side 110 of the transformer 100, the stray capacitance $C_s$ may also be represented either on the primary side 105, or the secondary side 110, where the value of the stray capacitance $C_s$ on the primary side 105 differs from the value of the stray capacitance $C_s$ on the secondary side 110 by approximately the square of the transformer primary to secondary turns ratio and/or the square of transformer's voltage step up ratio.

The stray capacitance $C_s$ as measured or seen on the secondary side 110 may, for example, be measured by connecting a capacitance meter across the output $V_{out}$, with the transformer disconnected from other components, with the secondary winding electrically opened somewhere along its length, either near its start, middle, or end, and with the transformer input $V_{in}$ open. The stray capacitance $C_s$ as measured or seen on the primary side 105 may, for example, be measured by connecting a capacitance meter across the transformer input $V_{in}$, with the primary winding electrically opened somewhere along its length, either near its start, middle, or end, and with the transformer 100 disconnected from other components, and with the transformer output $V_{out}$ open.

Electrically opening either the primary or secondary winding, for example, may mean that a small break (for example, a 0.1 mm separation) is put somewhere along the length of the winding, such that the winding input is no longer electrically connected to the winding output. This may be done, for example, to allow a standard capacitance meter to function properly and not be shorted out by a continuous winding.

The stray capacitance $C_s$ for example, may be less than 1 pF ($C_s$<1 pF). As another example, the stray capacitance $C_s$ may be less than 10 pF ($C_s$<10 pF), 100 pF ($C_s$<100 pF), etc. The stray capacitance $C_s$ may be the capacitance of the transformer 100 as measured on the secondary side 110 of the transformer 100 (or as measured from the secondary side 110 of the transformer 100 and/or at the transformer output $V_{out}$).

In some embodiments, the voltage at the output $V_{out}$ may be greater than 1 kV, 10 kV, 100 kV, etc. In some embodiments, these voltages may be achieved with an input voltage of less than 600 V. In other embodiments, these voltages may be achieved with an input voltage of less than 800 V, or less than 3600 V.

The transformer core 115 may have any number of shapes such as, for example, a toroid, a torus, a square toroid, a cylinder, a square toroidal shape, a polygonal toroidal shape, etc. The transformer core 115 may also have any cross sectional shape such as a square, polygonal or circular cross section.

In some embodiments, the transformer core 115 may be comprised of air, iron, ferrite, soft ferrite, MnZn, NiZn, hard ferrite, powder, nickel-iron alloys, amorphous metal, glassy metal, or some combination thereof.

In some embodiments, a transformer may include one or more single turn primary windings wound around the transformer core and a secondary winding wound around the transformer core. In some embodiments, the transformer may have a stray inductance of less than about 100 pH, 1 nH, 10 nH, 100 nH, etc. This low inductance may be an artifact of one or more of the following properties of the transformer: a single-turn primary winding, a plurality of single-turn primary windings wound in parallel, a secondary winding wound in parallel, a plurality of secondary windings that are wound in parallel, a transformer that is integrated with a printed circuit board, one or more cores stacked upon one another, the transformer coupled with a printed circuit board having a thickness less than 4 mm or less than 1 mm, the transformer coupled with a printed circuit board having a plurality of feedthroughs for the primary winding and/or the secondary winding, a polymer (e.g., polyimide) coating on the transformer core, a small core size (e.g., a core dimension less than about 1 cm), a secondary winding with a short length, a continuous primary winding, secondary windings where the spacing between individual turns of the secondary winding is varied, secondary windings where the spacing between the individual turns of the secondary windings and the primary windings is varied, etc.

In some embodiments, a transformer may include a single turn primary winding wound around the transformer core and a secondary winding wound around the transformer core. In some embodiments, the transformer may have an effective/equivalent capacitance $C_s$ of less than about 100 pF, 10 pF, 1 pF, etc. This low capacitance may be an artifact of one or more of the following properties of the transformer: thin wire diameters for the single turn primary winding (e.g., a diameter less than 24 AWG wire), thin wire diameters for the secondary winding (e.g., a diameter less than 24 AWG wire), the transformer is not potted, a plurality of secondary windings arranged in a plurality of groupings, winding the secondary winding with a space between the secondary winding and the transformer core, a plurality of parallel cores, a small core size (e.g., a core dimension less than about 1 cm), sequentially spacing consecutive secondary windings, secondary windings where the spacing between individual turns of the secondary winding is varied, secondary windings where the spacing between the individual turns of the secondary windings and the primary windings is varied, etc.

In some embodiments, the primary winding may include wires, sheets, traces, conductive planes, etc. or any combination thereof. In some embodiments, the primary winding may include wires having a conductor diameter from 0.1 mm up to 1 cm such as, for example, 0.1 mm, 0.5 mm, 1 mm, 5 mm, 1 cm, etc.

In some embodiments, the secondary winding may include wires, sheets, traces, conductive planes, etc. or any combination thereof. In some embodiments, the secondary winding may include wires having a conductor diameter from 0.1 mm up to 1 cm such as, for example, 0.1 mm, 0.5 mm, 1 mm, 5 mm, 1 cm, etc.

Figure 2:
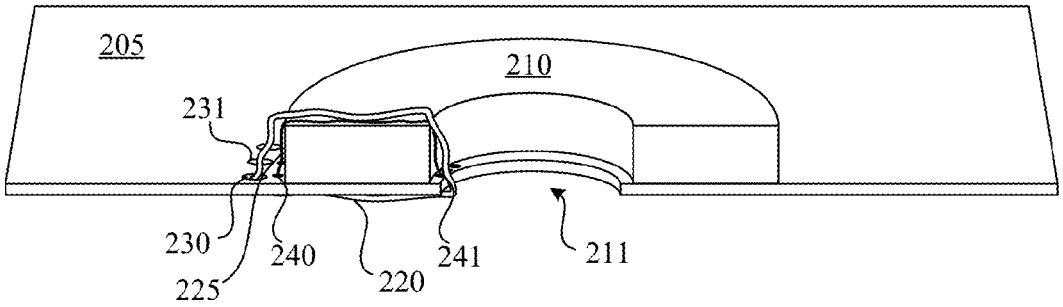
FIG. 2 illustrates a cutaway side view of a transformer with a single-turn primary winding and a multi-turn secondary winding that is wound around or partially around a transformer core according to some embodiments.

FIG. 2 illustrates a cutaway side view of a transformer with a single-turn primary winding 225 and a multi-turn secondary winding 220 that is wrapped around or partially around a transformer core 210 according to some embodiments. The single-turn primary winding 225, for example, may be wrapped around the transformer core 210 once or fewer than once (e.g., a single turn). While only one single-turn primary winding 225 is shown, a plurality of single-turn primary windings may be wrapped around or partially around the transformer core 210. In some embodiments, a single-turn primary winding 225 may include a combination of a wire that wraps around the transformer 210 as shown in the figure and a trace 261 on the circuit board.

A multi-turn secondary winding 220 may include a single wire that is wrapped around the transformer core more than one time. While only one turn of a multi-turn secondary winding 220 is shown, the wire may be wrapped around the transformer core 210 any number of times. For example, the multi-turn secondary winding 220 may be wrapped around the transformer core 210 more than 3, 10, 25, 50, 100, 250, 500, etc. times.

In some embodiments, the primary winding 225 may be disposed close to the core to reduce stray inductance. In some embodiments, all or portions of the secondary windings or some of the secondary windings may be spaced some distance away from the core to reduce stray capacitance.

In some embodiments, the primary winding 225 terminates at pad 240 on the circuit board 205 on the outer perimeter of the transformer core 210 and at pad 241 within the central hole of the toroid shaped transformer core 210. In some embodiments, the pad 241 may be coupled with a conductive circuit board trace on an internal or external layer of the circuit board 205. Alternatively or additionally, the conductive circuit board trace may include a conductive sheet and/or a conductive plane having any shape. The pad 240 and the pad 241 electrically couple the primary winding with the primary circuitry including, for example, a switch circuit and/or other components.

As shown, the secondary winding 220 is wrapped around the transformer core 210 by passing through hole 230 in the circuit board 205 located at the perimeter of the toroid shaped transformer core 210, the internal hole of the toroid shaped transformer core 210, and the hole 211 in the circuit board 205. Successive windings of the secondary winding 220 may pass through the hole 230 or another hole 231 in the circuit board. Additionally, successive windings of the secondary winding 220 may pass through hole 211 in the circuit board 205. The secondary winding 220 may be coupled with a secondary circuitry such as, for example, a compression circuit, output components, and/or a load. In some embodiments, a single secondary winding 220 may be wrapped around the transformer core 210 a plurality of times passing through a plurality of holes located on the perimeter of the transformer core 210 and the hole 211.

In some embodiments, the transformer core 210 may have a core dimension less than about 0.5 cm, 1 cm, 2.5 cm, 5 cm, and/or 10 cm. In some embodiments, the transformer core 210 may have a cross section area that can range, for example, from 1 sq. cm to 100 sq. cm. In some embodiments, the transformer core 210 may have a core diameter that can range from 1 cm to 30 cm.

Figure 3:
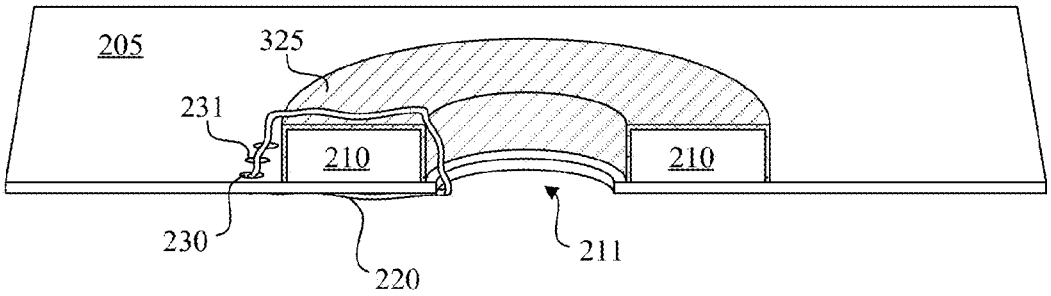
FIG. 3 illustrates a cutaway side view of a transformer with a single sheet primary winding and a multi-turn secondary winding wound around a transformer core according to some embodiments.

FIG. 3 illustrates a cutaway side view of a transformer with a single sheet primary winding 325 and a multi-turn secondary winding 220 wrapped around a transformer core 210 according to some embodiments. A single-turn primary winding, for example, may be wrapped around the transformer core 210 once or fewer than once (e.g., a single turn).

In some embodiments, the single sheet primary winding 325 may include a conductive sheet that is wrapped around at least a portion of the transformer core. As shown in FIG. 3, the single sheet primary winding 325 wraps around the outside, top, and inside surfaces of the transformer core. Conductive traces and/or planes on and/or within the circuit board 205 may complete the primary turn, and connect the primary turn to other circuit elements.

In some embodiments, the single sheet primary winding 325 may terminate on one or more pads on the circuit board 205. In some embodiments, the single sheet primary winding 325 may terminate with two or more wires.

In some embodiments, the single sheet primary winding 325 may include a conductive paint that has been painted on one or more outside surfaces of the transformer core 210. In some embodiments, the single sheet primary winding 325 may include a metallic layer that has been deposited on the transformer core 210 using a deposition technique such as thermal spray coating, vapor deposition, chemical vapor deposition, ion beam deposition, plasma and thermal spray deposition, etc. In some embodiments, the single sheet primary winding 325 may comprise a conductive tape material that is wrapped around the transformer core 210. In some embodiments, the single sheet primary winding 325 may comprise a conductor that has been electroplated on the transformer core 210.

In some embodiments, an insulator may be disposed between transformer core and the single sheet primary winding 325. The insulator, for example, may include a polymer, a polyimide, epoxy, etc.

A multi-turn secondary winding 220 may include a wire that is wrapped around the transformer core more than one time. While only one turn of a multi-turn secondary winding 220 is shown, the wire may be wrapped around the transformer core 210 any number of times. One or more secondary windings may be used in parallel to reduce the stray inductance.

In some embodiments, the secondary windings may be spaced some distance away from the core to reduce stray capacitance. Some examples are discussed below.

As shown, the secondary winding 220 may be wrapped around the transformer core 210 by passing through hole 230 in the circuit board 205 located at the perimeter of the toroid shaped transformer core 210, the internal hole of the toroid shaped transformer core 210, and the hole 211 in the circuit board 205. Successive windings of the secondary winding 220 may pass through hole 230 or another hole 231 in the circuit board. Additionally, successive windings of the secondary winding 220 may pass through hole 211 in the circuit board 205. The secondary winding 220 may be coupled with a secondary circuitry such as, for example, a compression circuit, output components, and/or a load. In some embodiments, a single secondary winding 220 may be wrapped around the transformer core 210 a plurality of times passing through a plurality of holes located on the perimeter of the transformer core 210 and the hole 211.

Figure 9:
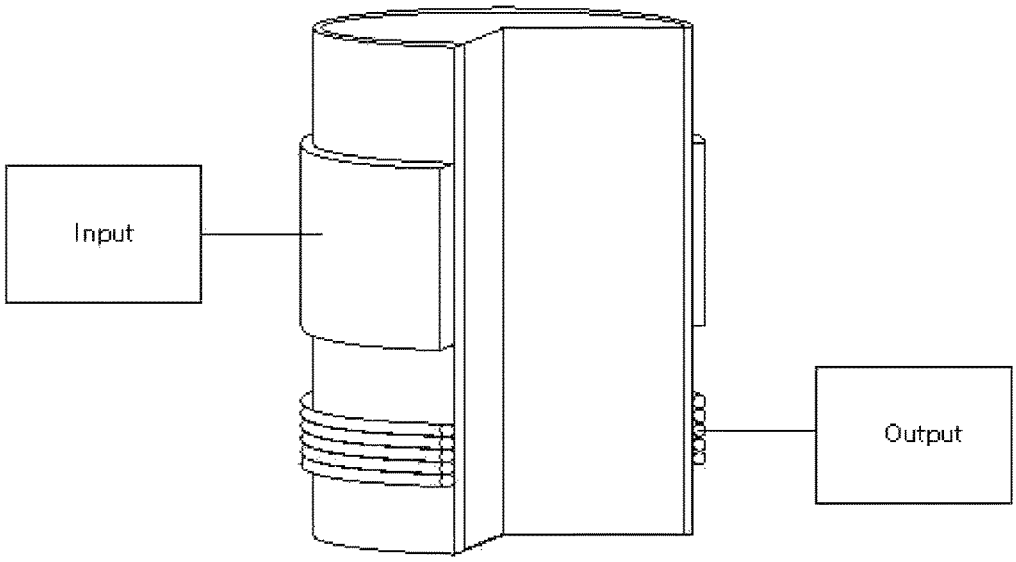
FIG. 9 is a diagram of an example transformer core according to some embodiments.

The transformer may have any shape. The transformer shown in FIGS. 2 and 3 are shown with a toroidal shape with a rectangular cross-section—a square toroidal shape. A round toroid shape may also be used. The transformer core may also have a cylinder shape, for example, with primary and/or secondary windings wound around portions of the cylinder as shown in FIG. 9. As another example, the transformer core may also have a polygonal shape with a square, polygonal or circular cross section and with a square, circular, or polygonal hole within the polygonal shape. Many other core shapes may be used.

The transformer cores used in the various embodiments may have at least one dimension greater than 1 cm. The dimension, for example, may include the inner radius of the transformer core hole, the outer radius of the transformer core, the height of the transformer core, etc. In some embodiments, the transformer core may have at least one dimension greater than 2 cm, 3 cm, 5 cm, 10 cm, 20 cm, etc.

Figure 4A:
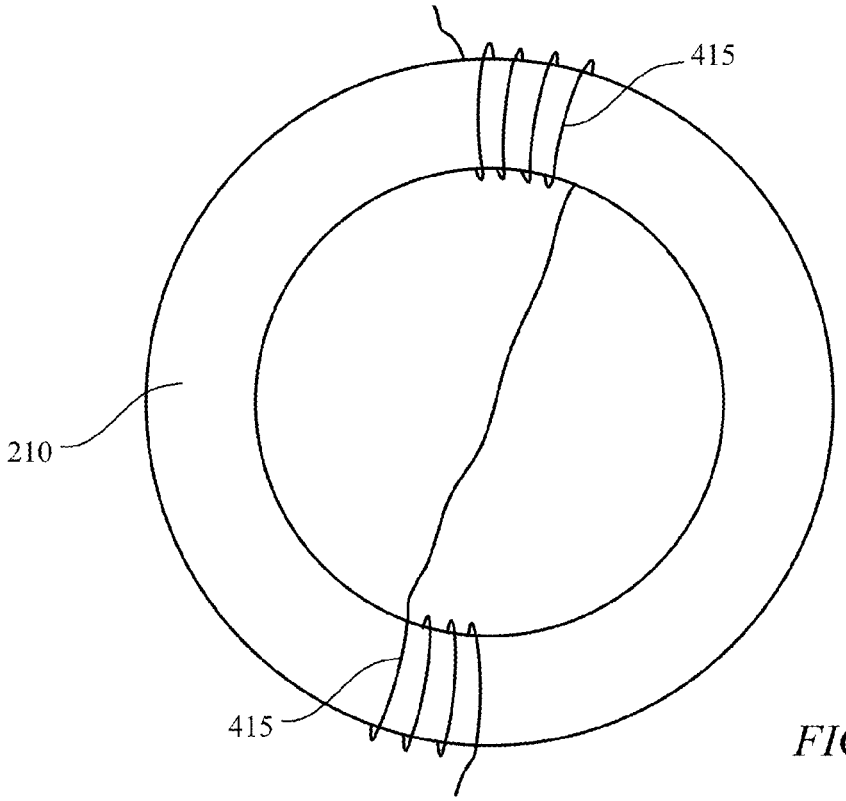
FIG. 4A is a top view of a transformer core having a toroid shape with a spread out secondary windings according to some embodiments.

FIG. 4A is a top view of a transformer core 210 having a toroid shape with a spread out secondary windings 415. In this example, the secondary windings 415 are spread out in two positions on the transformer core 210. The windings in each position are electrically coupled together to ensure that the secondary winding is a single wound wire.

Figure 4B:
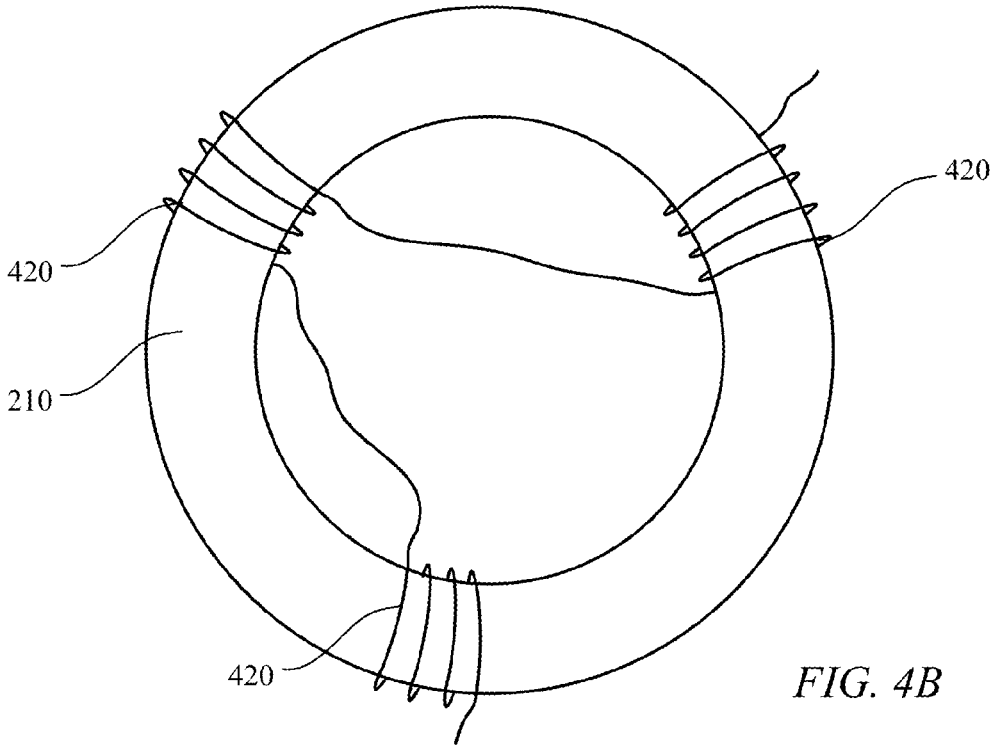
FIG. 4B is a top view of a transformer core having a toroid shape with three spread out secondary windings according to some embodiments.

FIG. 4B is a top view of a transformer core 210 having a toroid shape with three spread out secondary windings 420. In this example, the secondary windings 420 are spread out in three positions on the transformer core 210. The windings in each position are electrically coupled together to ensure that the secondary winding is a single wound wire. Any number of spread out groupings of windings may be used such as, for example, one to six groupings.

Figure 5A:
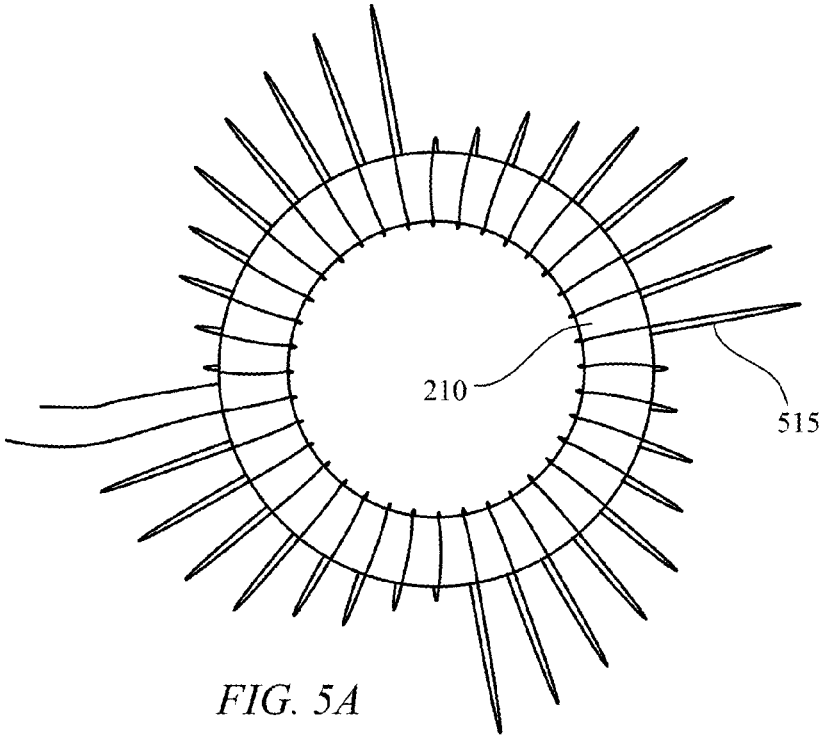
FIG. 5A is a top view of a transformer core having a toroid shape and a secondary winding with individual winds sequentially spaced further from the transformer core according to some embodiments.

FIG. 5A is a top view of a transformer core 210 having a toroid shape and a secondary winding 515 with individual winds sequentially spaced further from the transformer core. In this example, four groups of secondary windings 515 are progressively spaced further from the transformer core 201 than one of the neighboring windings. In some embodiments, every winding of the secondary winding 515 may be spaced further apart from the transformer core than one of the neighboring windings. The spacing between individual turns of the windings may also be varied. On the low voltage side the spacing between windings may be small, but as the voltage increases, the spacing between the windings may increase, and or the distance between the windings and the core may increase.

Figure 5B:
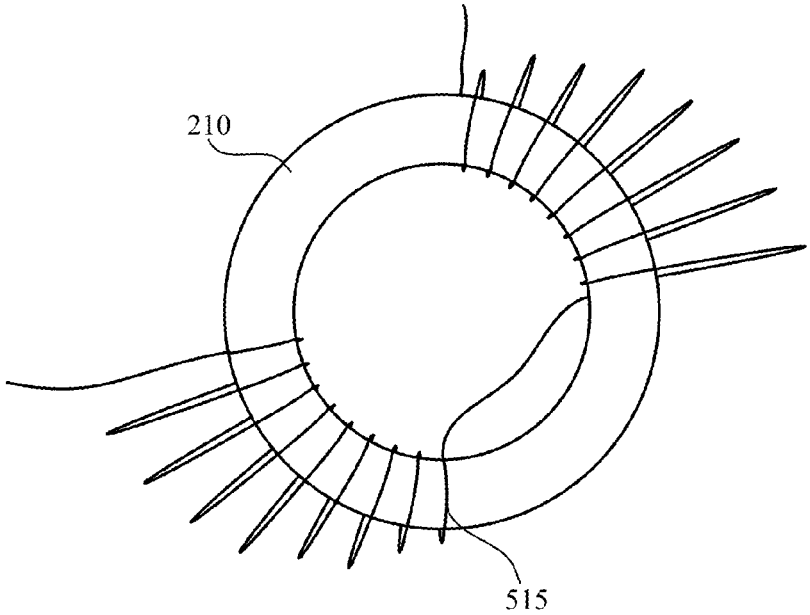
FIG. 5B is a top view of a transformer core having a toroid shape and two groups of a secondary winding with individual winds in each group sequentially spaced further from the transformer core according to some embodiments.

FIG. 5B is a top view of a transformer core 210 having a toroid shape and two groups of a secondary winding 515 with individual winds in each group sequentially spaced further from the transformer core.

In some embodiments, the grouping of secondary windings in different positions along, on, or around the transformer core may reduce or diminish the possibility of a corona discharge occurring in the transformer. Corona can be caused by the ionization of gases surrounding the transformer when the voltage is high enough to form a conductive region in the surrounding gases. By separating the secondary winding into groupings, for example, as shown in FIGS. 4A, 4B, 5A, and 5B, the electric field in the core may be lowered resulting in lower probability of generating corona.

In some embodiments, a plurality of transformer cores may be stacked one upon another. In some embodiments, each individual transformer core may include one or more primary windings whereas the secondary winding is wound around two or more of the plurality of transformer cores.

Figure 6:
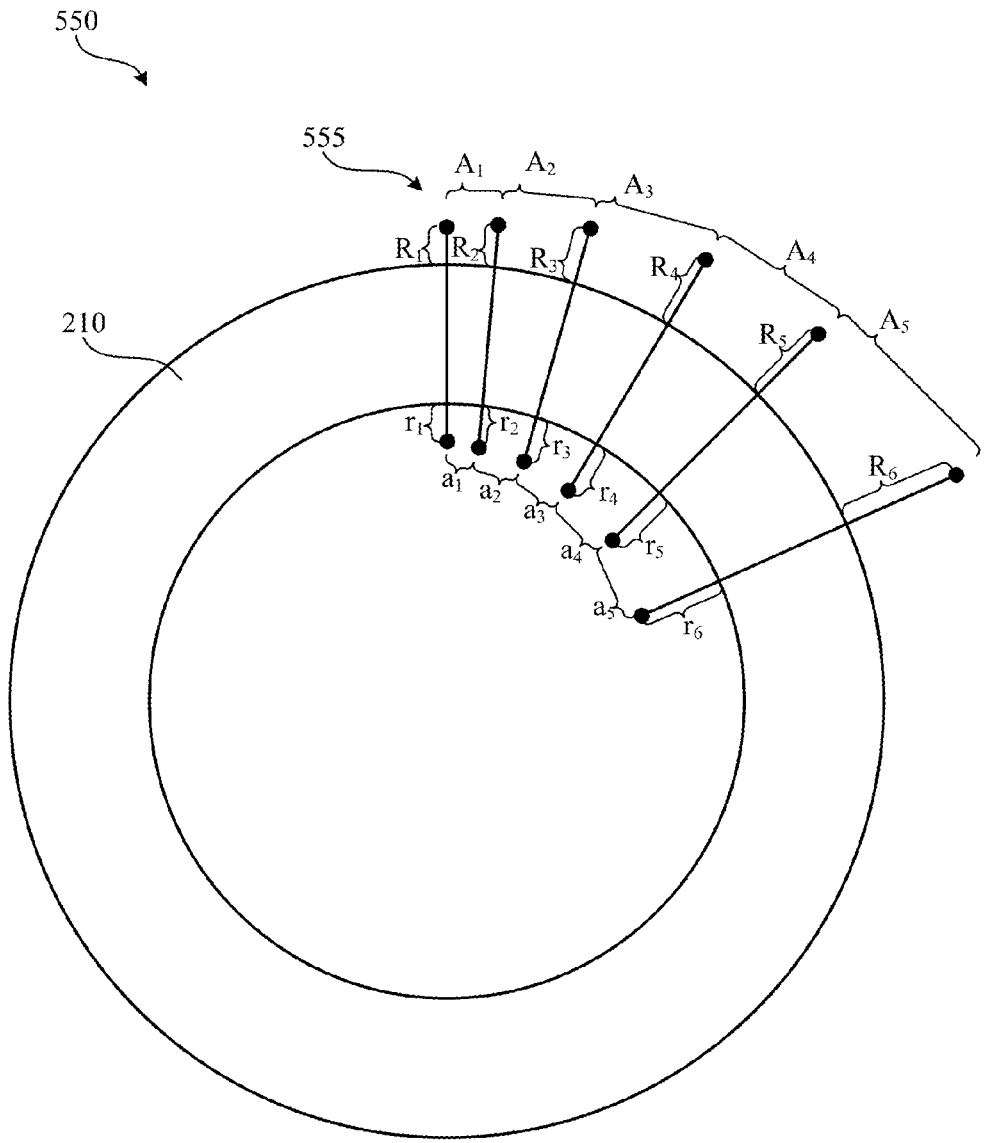
FIG. 6 is a top view of a transformer core having a toroid shape with a secondary winding having specific distances between adjacent turns of the secondary winding and/or specific distances between turns of the secondary winding and the core according to some embodiments.

FIG. 6 is a top view of a transformer core 550 having a toroid shape with a secondary winding 555 having specific distances between adjacent turns of the secondary winding and/or specific distances between turns of the secondary winding and the transformer core 210 according to some embodiments. While six turns of the secondary winding 555 are shown with specific distances between adjacent turns, any number of turns of the secondary winding 555 may be arranged in this way. For example, two turns of a secondary winding 555 may be used with a specific distance between the two turns of the secondary winding 555 and/or between the two turns of the secondary winding 555 and the transformer core 210. In the figure, R and r represent a minimum distance between adjacent turns of the secondary winding 555 and the transformer core 210. In some embodiments, these values may be constant for a given secondary winding such as, for example, $r_1=R_1$, $r_2=R_2$, . . . $r_n=R_n$.

A and a represent the separation between the individual turns of the secondary winding 555, or sets of turns of the secondary winding 555. For toroidal cores, for example, each A may always be larger than the corresponding a. In other examples A may equal a.

The values of R, r, A, and a, may be selected, for example, to control the size of the electric field between respective turns of the secondary winding 555 and any other component. In some embodiments, it might be desirable to control the electric field between turns of the secondary winding, between turns of the secondary winding 555 and the core, and/or between turns of the secondary winding and the primary winding. This can be done, for example, to control corona, stray inductance, and/or stray capacitance.

The values of R, r, A, and a, may be selected, for example, to control the mutual inductive coupling between respective turns of the secondary winding 555 and/or their mutual inductive coupling with other components. This can be done, for example, to control stray inductance. In some embodiments, it might be desirable to select values of R, r, A, a, to establish a particular ratio between the stray capacitance and the stray inductance.

The electric field, for example, may be measured in Volts per mil, where 1 mil is 1/1000th of an inch. As the voltage on each successive secondary turn increases, it needs to be kept farther away from the transformer core 210 and the primary windings to keep the V/mil (electric field) constant. In some embodiments, each turn of the secondary winding 555 could have the same separation from an adjacent turns of the secondary winding to, for example, preserve a constant electric field between them. In some embodiments, the separation between adjacent turns of the secondary winding may be increased to match the separation from the core in order to also control the stray inductance that arises from turn to turn mutual coupling. In some embodiments, the farther the individual turns are spaced from each other, the lower their stray mutual coupling is.

In some embodiments, the spacing between one or more turns of the secondary winding 555 and the transformer core 210 or the primary winding can be increased to keep the electric field less than about 500 V/mil, 400 V/mil, 300 V/mil, 200 V/mil, 100 V/mil, 50 V/mil, 40 V/mil, 30 V/mil, 20 V/mil, 10 V/mil, 5 V/mil in a gas; or less than about 5000 V/mil, 4000 V/mil, 3000 V/mil, 2000 V/mil, 1000 V/mil, 500 V/mil, 400 V/mil, 300 V/mil, 200 V/mil, 100 V/mil, 50 V/mil in a liquid (e.g., oil).

In some embodiments, $R_i \approx A_i$ and/or $r_i \approx a_i$. In some embodiments, $R_i \approx 0.1\ A_i$ and/or $r_i \approx 0.1\ a_i$. In some embodiments, $R_i \approx 0.5\ A_i$ and/or $r_i \approx 0.5\ a_i$. In some embodiments, $R_i \approx 10\ A_i$ and/or $r_i 10\ a_i$. In some embodiments, $R_i \approx 5\ A_i$ and/or $r_i \approx 5\ a_i$.

Figure 7:
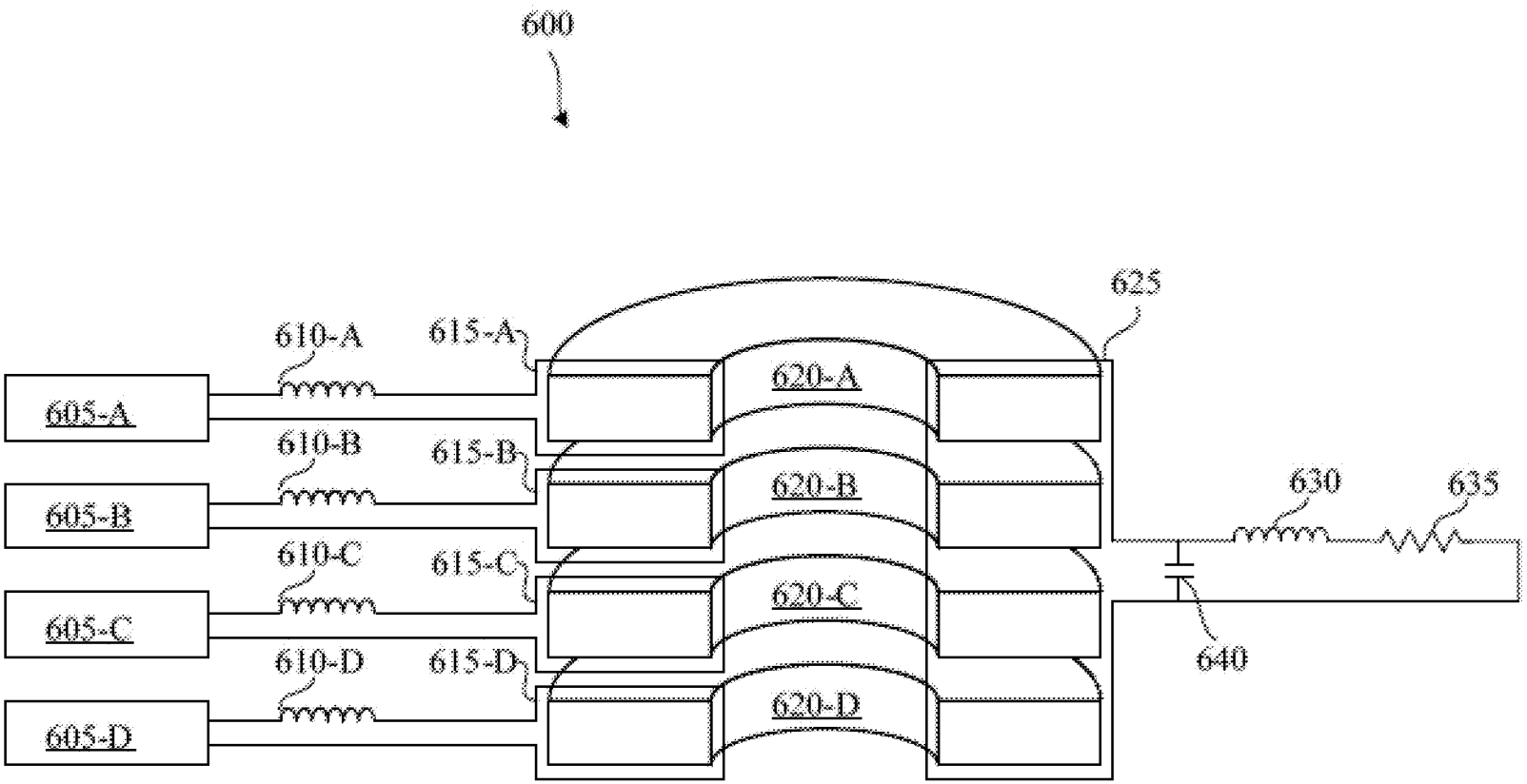
FIG. 7 is a diagram of a multi-transformer core transformer according to some embodiments.

FIG. 7 is a diagram of a multi-transformer core transformer 600 according to some embodiments. The multi-transformer core transformer 600 includes four inputs, 605-A, 605-B, 605-C and 605-D. Each input 605 may be coupled with a primary winding 615 that is wound at least partially around transformer core 620 of a transformer. Stray inductance 610 (e.g., collectively or individually 610A, 610B, 610C, and/or 610D) may be found between and/or as part of the primary winding 615.

The secondary winding 625 may be wound around all four transformer cores 620-A, 620-B, 620-C and 620-D (or two or more of the transformer cores) of the multi-transformer core transformer 600. The secondary winding 625 may include secondary stray inductance 630 and/or the secondary stray capacitance 640. In some embodiments, the secondary stray capacitance 640 may be less than 1 pF, 10 pF, 100 pF, etc. In some embodiments, the secondary stray inductance 630 may be less than 10 nH, 100 nH, 1000 nH, etc. In addition, the multi-transformer core transformer 600 may be used to drive a high voltage to the load 635. In some embodiments, the stray inductance 610 may be less than 100 nH, 10 nH, 1 nH, 0.1 nH, etc.

In some embodiments, the secondary winding 625 of the multi-transformer core transformer 600 can include any type of winding configuration such as, for example, a winding configuration shown in FIGS. 4A, 4B, 5A, 5B, and/or 6. In some embodiments, the secondary winding 625 may include any number of windings and/or may include windings with any type of spacing. In some embodiments, any type of secondary winding 625 may be considered. Alternatively or additionally, the primary windings 615 of the multi-transformer core transformer 600 can include, for example, wires, sheets, traces, conductive planes, etc. or any combination thereof.

Figure 8:
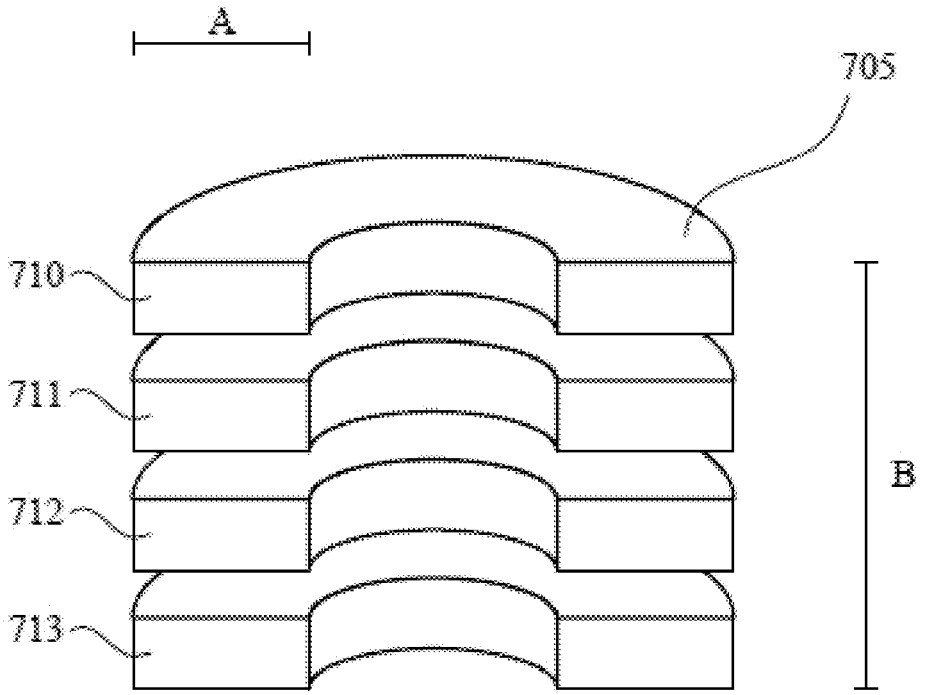
FIG. 8 shows a cutaway side view of four transformer cores stacked together and illustrates an example of how the perimeter and cross sectional area may be calculated.

In some embodiments, the stray inductance and/or stray capacitance within one or more transformer cores 620 can be lowered and/or minimized by some combination of minimizing the total perimeter of one or more transformer core combinations and/or maximizing the cross sectional surface area with respect to the perimeter of one or more transformer core combinations. FIG. 8 shows a cutaway side view of four transformer cores 710, 711, 712, and 713 stacked together and illustrates an example of how the perimeter and cross sectional area may be calculated. In this example, the perimeter of a cross section of a transformer core stack can be calculated as P=A+B and the area of a cross section of a transformer core stack can be calculated from P=AB.

In some embodiments, insulation can be placed between various portions of the secondary winding(s) and the primary winding(s) and/or the transformer core(s).

In some embodiments, the primary winding (or windings) may have a diameter that is less than the diameter of secondary winding conductor.

The term "substantially" means within 5% or 20% of the value referred to or within manufacturing tolerances.

Various embodiments are disclosed. The various embodiments may be partially or completely combined to produce other embodiments.

Numerous specific details are set forth herein to provide a thorough understanding of the claimed subject matter. However, those skilled in the art will understand that the claimed subject matter may be practiced without these specific details. In other instances, methods, apparatuses, or systems that would be known by one of ordinary skill have not been described in detail so as not to obscure claimed subject matter.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for-purposes of example rather than limitation, and does not preclude inclusion of such modifications, variations, and/or additions to the present subject matter as would be readily apparent to one of ordinary skill in the art.

That which is claimed:

1. A high-voltage transformer comprising:

a transformer core;

at least one primary winding wound at least partially around the transformer core;

a secondary winding wound around the transformer core a plurality of times;

an input electrically coupled with the primary windings; and an output electrically coupled with the secondary windings that provides a voltage greater than 1200 volts, wherein the transformer has at least one dimension selected from the group consisting of a radius, a width, a height, an inner radius, and an outer radius that is greater than 3 cm;

wherein the high-voltage transformer has a stray inductance of less than 30 nH as measured on the primary side and the transformer has a stray capacitance of less than 100 pF as measured on the secondary side, wherein the primary side includes the at least one primary winding, and the secondary side includes the at least one secondary winding.

2. The high-voltage transformer according to claim 1, wherein the primary winding comprises a wire and a trace on a circuit board.

3. The high-voltage transformer according to claim 1, wherein the at least one primary winding comprises a plurality of conductors wound less than one time around the transformer core.

4. The high-voltage transformer according to claim 1, wherein the at least one secondary winding comprises a single conductor wound around the transformer core a plurality of times.

5. The high-voltage transformer according to claim 1, wherein the transformer core has a toroid shape.

6. The high-voltage transformer according to claim 1, wherein the transformer core has a cylinder shape.

7. The high-voltage transformer according to claim 1, wherein the secondary winding comprises at least a first group of windings wound around the transformer core at a first location and a second group of windings wound around the transformer core at a second location that is separate from the first location.

8. The high-voltage transformer according to claim 1, wherein each of at least a subset of the secondary windings are spaced further apart from the transformer core than one of a neighboring winding of the subset of the secondary windings.

9. The high-voltage transformer according to claim 1, wherein each of a first subset of the secondary windings are spaced further apart from a second subset of the secondary windings.

10. A high-voltage transformer comprising:

a transformer core;

at least one primary winding wound once or less than once around the transformer core;

a secondary winding wound around the transformer core a plurality of times;

an input electrically coupled with the primary windings; and an output electrically coupled with the secondary windings that provides a voltage greater than 1200 volts;

wherein the high-voltage transformer has a stray inductance of less than 30 nH as measured on the primary side and the transformer has a stray capacitance of less than 100 pF as measured on the secondary side, wherein the primary side includes the at least one primary winding, and the secondary side includes the at least one secondary winding.

11. The high-voltage transformer according to claim 10 wherein the primary winding comprises a wire and a trace on a circuit board.

12. A high-voltage transformer comprising:

a first transformer core;

a first primary winding wound at least partially around the first transformer core;

a second transformer core;

a second primary winding wound at least partially around the second transformer core;

a secondary winding wound a plurality of times around both the first transformer core and the second transformer core;

an input electrically coupled with the primary windings; and an output electrically coupled with the secondary windings that provides a voltage greater than 1200 volts;

wherein the high-voltage transformer has a stray inductance of less than 30 nH as measured on the primary side and the transformer has a stray capacitance of less than 100 pF as measured on the secondary side, wherein the primary side includes the at least one primary winding, and the secondary side includes the at least one secondary winding.

13. The high-voltage transformer according to claim 12, wherein the first primary winding comprises a wire and a trace on a circuit board, and wherein the second primary winding comprises a wire and a trace on a circuit board.

14. The high-voltage transformer according to claim 12, further comprising:

one or more additional transformer cores; and one or more additional primary windings, each of the one or more additional primary windings wound once or less than once around the a respective one of the one or more additional transformer cores;

wherein the secondary winding is wound around the first transformer core, the second transformer core, and the one or more additional transformer cores a plurality of times.

15. A high-voltage transformer comprising:

a transformer core having a cylinder shape;

an insulator disposed on surfaces of the transformer core;

a conductor sheet disposed on the insulator and disposed around a portion of the transformer core;

a secondary winding comprising a wire wound around the conductor sheet and the transformer core a plurality of times;

an input electrically coupled with the conductor sheet; and an output electrically coupled with the secondary windings that provides a voltage greater than 1200 volts wherein the high-voltage transformer has a stray inductance of less than 30 nH as measured on the primary side and the transformer has a stray capacitance of less than 100 pF as measured on the secondary side, wherein the primary side includes the at least one primary winding, and the secondary side includes the at least one secondary winding.

* * * * *